US007266915B2

(12) United States Patent
Lee

(10) Patent No.: US 7,266,915 B2
(45) Date of Patent: Sep. 11, 2007

(54) DOUBLE-SIDED IRONING BOARD

(76) Inventor: Gi Beom Lee, #102, 685-5, Yeoksam 1-Dong, Gangnam-Gu, Seoul (KR)

( * ) Notice: Subject to any disclaimer, the term of this patent is extended or adjusted under 35 U.S.C. 154(b) by 0 days.

(21) Appl. No.: 10/500,166

(22) PCT Filed: Jan. 29, 2004

(86) PCT No.: PCT/KR2004/000157

§ 371 (c)(1),
(2), (4) Date: Jun. 23, 2004

(87) PCT Pub. No.: WO2004/085733

PCT Pub. Date: Oct. 7, 2004

(65) Prior Publication Data

US 2005/0120597 A1 Jun. 9, 2005

(30) Foreign Application Priority Data

Feb. 14, 2003 (KR) ..... 20-2003-0004334
Aug. 26, 2003 (KR) ..... 10-2003-0059295

(51) Int. Cl.
*D06F 81/00* (2006.01)
*D06F 81/02* (2006.01)

(52) U.S. Cl. ..... 38/136

(58) Field of Classification Search ..... 38/135, 38/136, 137, 138, 139, 112, 104, 103, 140; 223/57, 66
See application file for complete search history.

(56) References Cited

U.S. PATENT DOCUMENTS

| | | | | | |
|---|---|---|---|---|---|
| 486,347 | A | * | 11/1892 | Leland | 38/135 |
| 580,017 | A | * | 4/1897 | Sutton et al. | 38/103 |
| 914,956 | A | * | 3/1909 | Kenan | 38/103 |
| 1,059,778 | A | * | 4/1913 | Solomon | 223/57 |
| 2,652,646 | A | * | 9/1953 | Cave, Jr. | 38/136 |
| 2,803,897 | A | * | 8/1957 | Miyamoto | 38/137 |
| 4,689,905 | A | * | 9/1987 | Vartan | 38/26 |
| 4,819,559 | A | * | 4/1989 | Szarka | 101/474 |

* cited by examiner

*Primary Examiner*—Ismael Izaguirre
(74) *Attorney, Agent, or Firm*—Roth & Goldman, P.A.

(57) ABSTRACT

The present invention relates to an ironing plate. Double sides may be used for ironing. In the present invention, front and back surfaces as well as curved portions of clothes are effectively ironed without forming wrinkles in a state that clothes are putted onto an ironing plate through a 3D ironing surface formed based on the curves of human body. In addition, ironing parts are provided based on the characteristic of each part of upper garment, sleeve of upper garment and lower garment for thereby enhancing an ironing efficiency.

6 Claims, 12 Drawing Sheets

DOUBLE-SIDED IRONING BOARD

TECHNICAL FIELD

The present invention relates to an ironing plate, and in particular to a double-sided ironing plate in which it is possible to use double sides in one ironing plate, and an ironing is performed on front and back sides in a state that a certain suit of clothes is placed, and there is provided a 3-dimensinal ironing surface, so that a certain curved portion such as a hip portion can be effectively ironed.

BACKGROUND ART

Generally, as shown in FIG. 1, a conventional ironing plate 100 includes a plane ironing surface 104 fabricated with a certain length wherein a certain ironing object is placed on an upper surface of the same, and an inclination part 16 formed at one end of the ironing surface 104 at a certain inclination angle for thereby effectively ironing a portion of sleeve. Foldable legs 102 are provided on a back surface of the ironing surface 104.

In the conventional ironing plate 100, there are the following disadvantages when ironing clothes.

In the case that a Y-shirt is ironed, the front surface and back surface of the Y-shirt are arranged on the ironing surface 104 for ironing the front and back surfaces of the Y-shirt. Therefore, it takes a long time for ironing. In addition, in the case that the previously ironed portion is overlapped with a non-ironed portion, the ironed portion may be wrinkled. In this case, the wrinkled portions should be re-ironed.

In addition, in the case that a trousers is ironed, a certain problem occurs when a front side having a lot of wrinkles is ironed for the reason that the conventional ironing plate has a plane ironing surface 104, but the front side, hip portion and pocket portion are actually protruded.

Therefore, there are a lot of inconveniences for ironing the front sides of the trousers having wrinkles.

DISCLOSURE OF INVENTION

Accordingly, it is an object of the present invention to provide a double-sided ironing plate capable of overcoming the problems encountered in the conventional art.

It is another object of the present invention to provide a double-sided ironing plate in which double sides are used for ironing in one ironing plate, and a front side or a back side as well as a curve portion of clothes is well ironed in a state that a suit of clothes is inputted into an ironing plate for thereby preventing a certain wrinkle, and it is possible to enhance an ironing efficiency in such a manner that a certain ironing part is provided based on a certain portion in an upper garment, a sleeve of upper garment, and a lower garment.

To achieve the above objects, in an ironing plate designed to iron clothes, there is provided a double-sided ironing plate, comprising a sleeve part having a rectangular cross section wherein a sleeve part of clothes is putted onto the same; a shirt part that is integrally connected with the sleeve part and has a human body shaped cross section so that front and back surfaces of clothes are ironed in a state that an upper garment is putted onto the ironing plate; and a lower garment part that is connected with the shirt part and is formed in a dovetail shape for thereby performing an ironing operation in a state that a lower garment is putted on, wherein one surface of the sleeve part, shirt part and lower garment part forming the ironing part is plane, and the back surface is formed of a 3D curved surface.

In the present invention, the ironing plate includes a leg part capable of maintaining an inverted state of one surface and a back surface of the ironing plate so that a double surface ironing is achieved by changing the front and back surfaces in a state that clothes are putted on, wherein the leg part includes a support frame; a plurality of legs wherein one end of each of the same is connected with the support frame; and a support groove and an insertion groove formed in the ironing plate in such a manner that the legs are crossed from each other, and a hinge portion is formed at the crossing portion, and the other end of each of the legs is positioned.

BRIEF DESCRIPTION OF DRAWINGS

The present invention will become better understood with reference to the accompanying drawings which are given only by way of illustration and thus are not limitative of the present invention, wherein.

BEST MODE FOR CARRYING OUT THE INVENTION

Figure 1:
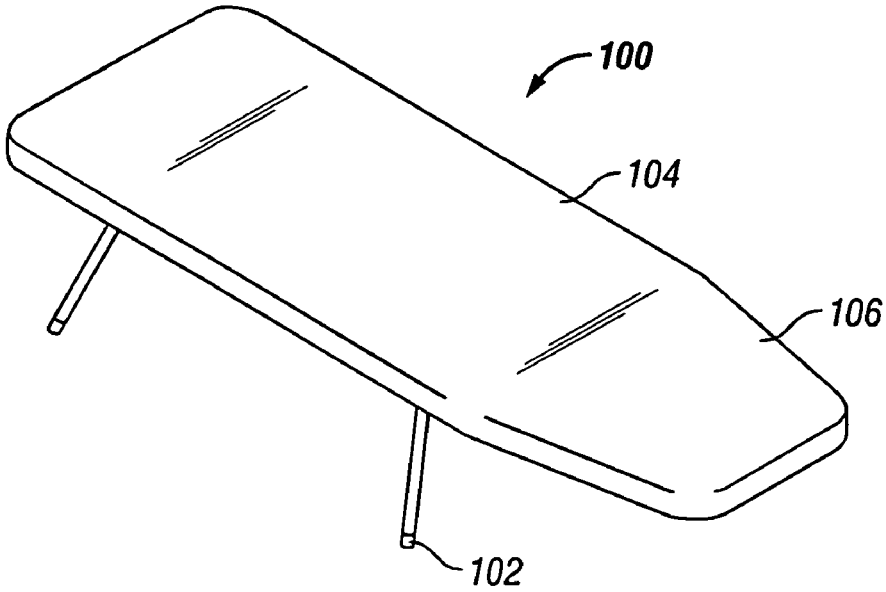
FIG. 1 is a perspective view illustrating a conventional ironing plate.

A first embodiment of the present invention will be described with reference to the accompanying drawings. The same reference numerals of the drawings correspond to the same elements having the same functions.

Figure 2:
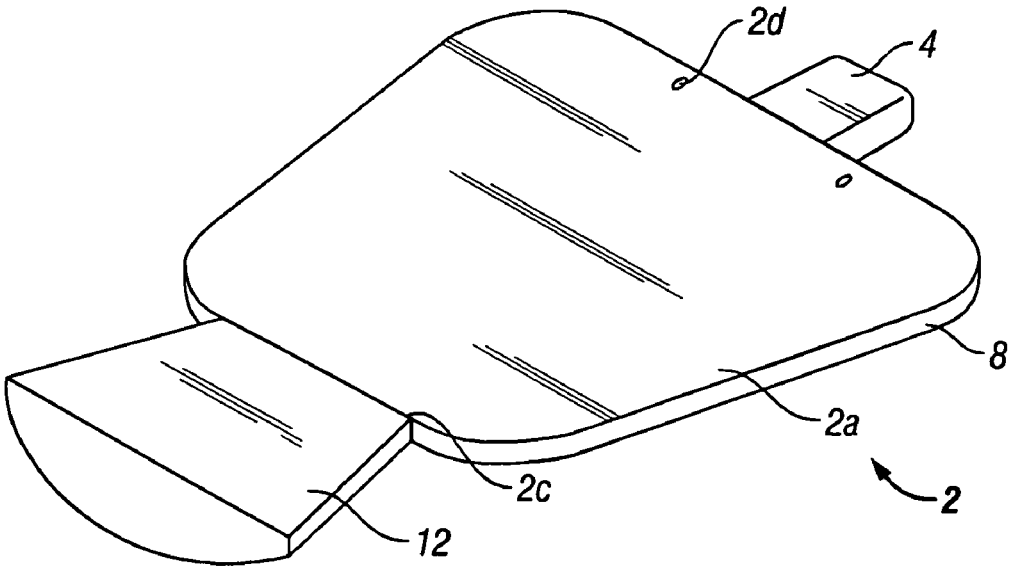
FIG. 2 is a perspective view illustrating a plane part of a double-sided ironing plate according to a first embodiment of the present invention.
Figure 3:
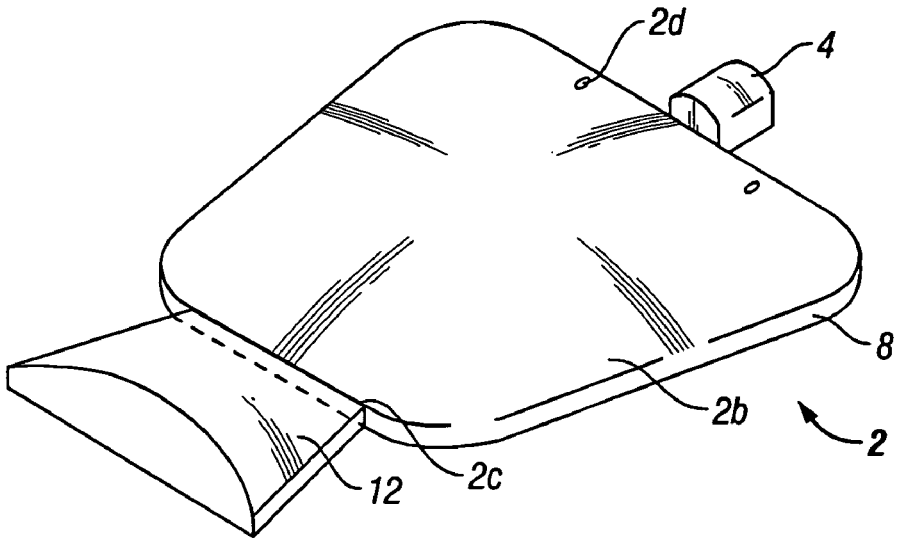
FIG. 3 is a perspective view illustrating a curved part of a double-sided ironing plate according to a first embodiment of the present invention.

As shown in FIGS. 2 and 3, the double-sided ironing plate 2 is designed to perform an ironing operation using double sides. One surface of the ironing plate 2 is formed of a plane surface 2*a*, and the other surface of the same is formed of a curved surface 2*b* having a three-dimension protrusion.

The ironing plate 2 has an ironing part having various purposes of use. A sleeve part 4 is provided at one end of the ironing plate 2 for ironing sleeves of Y-shirt, etc.

Figure 4:
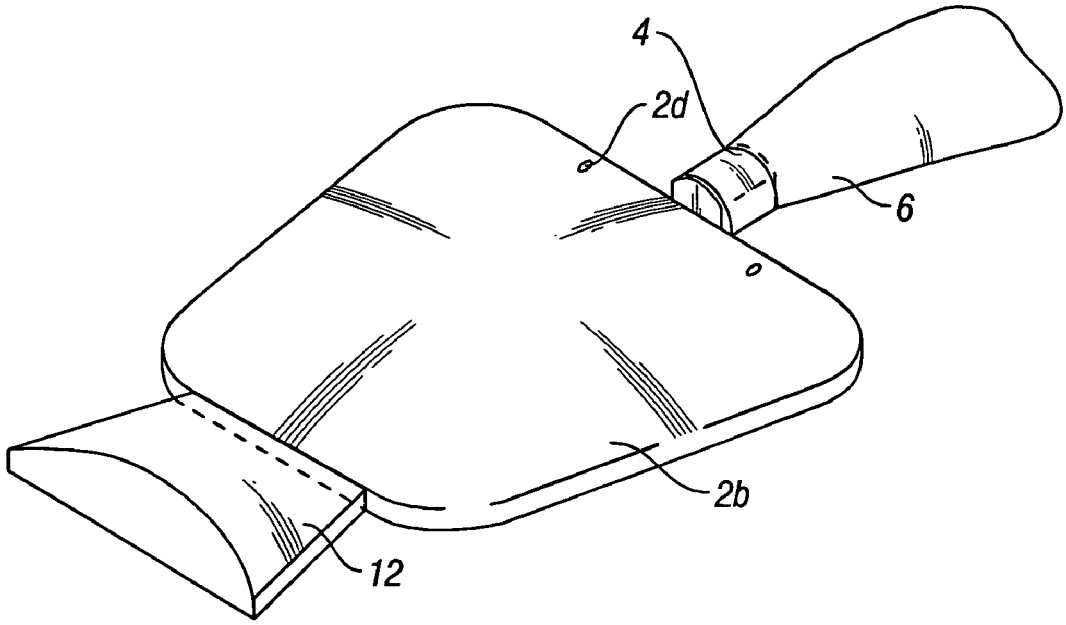
FIG. 4 is a perspective view illustrating a state that a sleeve part is inserted onto a double-sided ironing plate according to a first embodiment of the present invention.

The sleeve part 4 has a rectangular cross section wherein a sleeve 6 of clothes is inserted onto the same. As shown in FIG. 4, in a state that the sleeve 6 is inserted, an ironing operation is performed.

Figure 5:
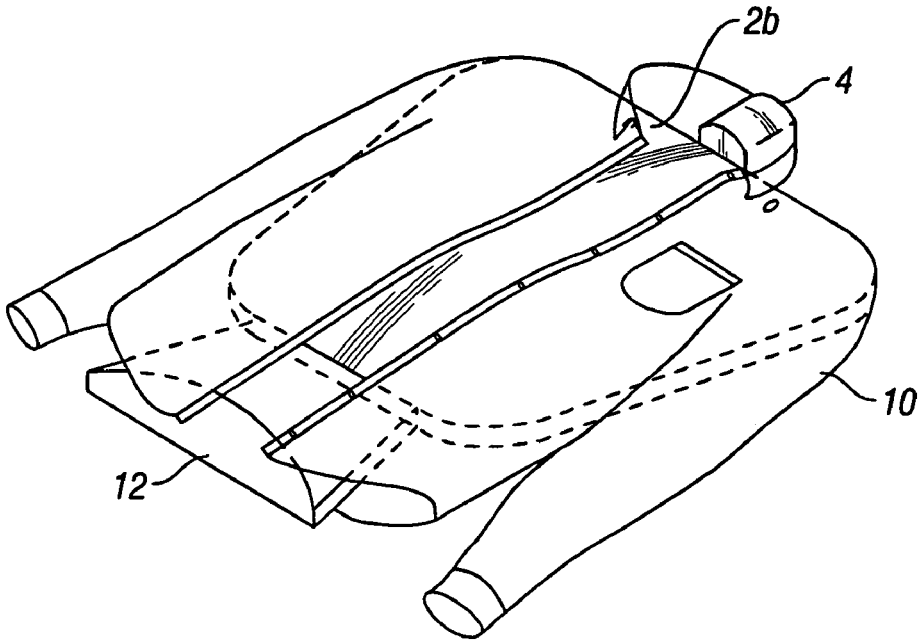
FIG. 5 is a perspective view illustrating a state that an upper garment of clothes is worn onto a double-sided ironing plate according to a first embodiment of the present invention.

In addition, a shirt part 8 is formed at an intermediate portion of the ironing plate 2 connected with the sleeve part 4, so that an upper garment such as Y-shirt, etc. is worn. As shown in FIG. 5, it is possible to iron a suit of clothes like the Y-shirt 10 is worn to a person.

At this time, the back surface of the upper garment is positioned at the plane surface 2*a* of the ironing plate 2, and the front surface of the upper garment is positioned at the curved portion 2*b* of the ironing plate 2.

Figure 6:
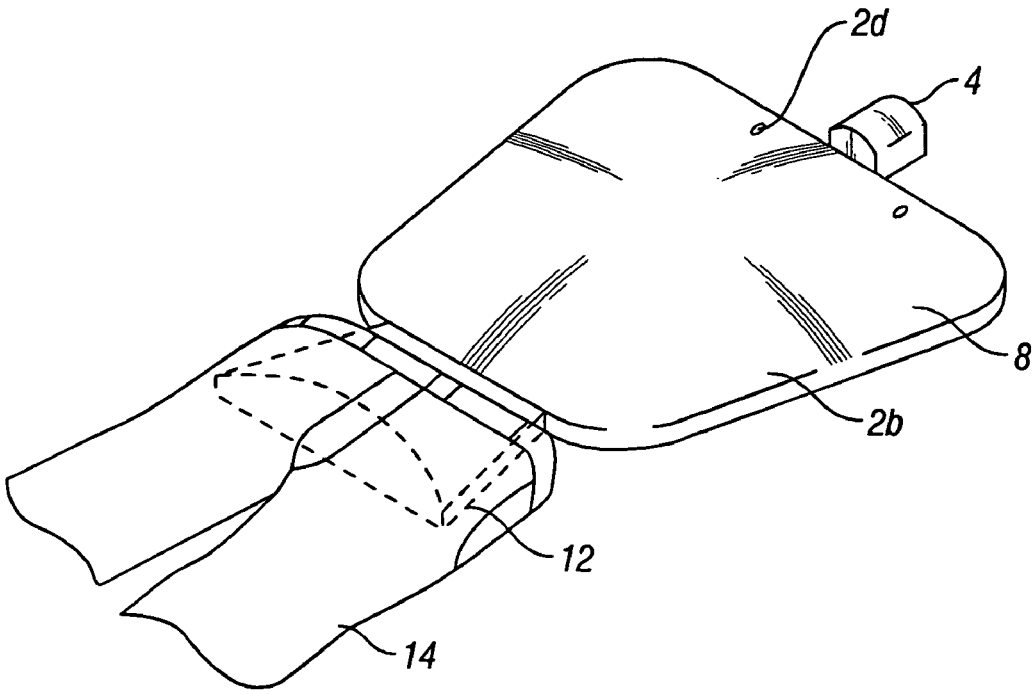
FIG. 6 is a perspective view illustrating a state that a lower garment is worn onto a double-sided ironing plate according to a first embodiment of the present invention.

In addition, a lower garment part 12 of a dovetail shape is formed in a lower side of the ironing plate 2 wherein a lower garment such as trousers is worn. As shown in FIG. 6, the trousers are worn into the lower garment part 12 for thereby ironing the lower garment.

Since the curved surface 2*b* of the back surface of the ironing plate 2 to which the trousers 14 are worn are protruded, when ironing the front side of the trousers 14, it is possible to easily iron. In addition, the backside and lateral side of the trousers 14 are effectively ironed.

Figure 7:
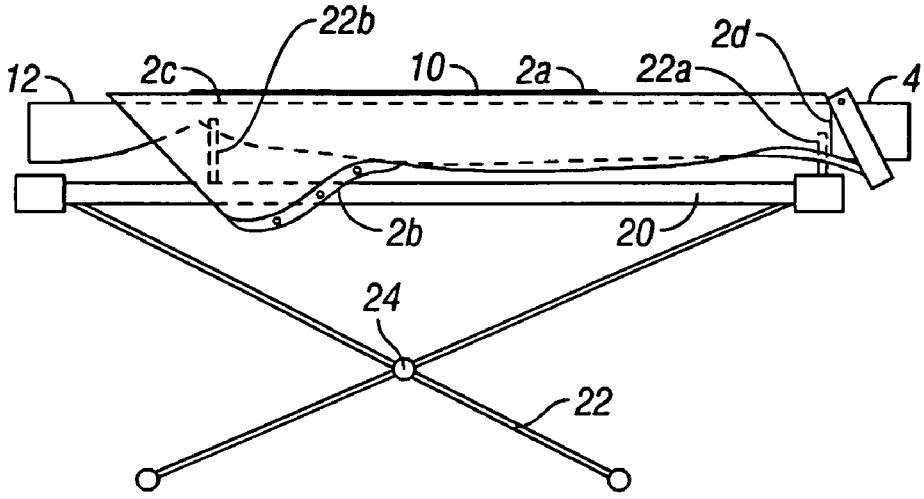
FIG. 7 is a view illustrating a state that a plane part of a double-sided ironing plate is used according to a first embodiment of the present invention.

In the double-sided ironing plate 2 according to the present invention, it is possible to iron the front and back surfaces of the clothes using only the ironing plate 2. In another embodiment of the present invention, as shown in FIG. 7, the leg part 18 may be provided for more conveniently ironing the front and back surfaces.

In the leg part 18, there is provided a support frame 20. A plurality of legs 22 are provided on the upper side of the support frame 20 wherein one end of the support frame 20 is rotatably engaged with the legs 22, respectively. The legs 22 are crossed from each other, and the crossing point is hinged.

The other ends of the legs 22 are supported by the support grooves 2*c* and insertion grooves 2*d* formed in the ironing plate 2, so that the front and back surfaces of the ironing plate 2 are supported.

The use of the double-sided ironing plate 2 according to the first embodiment of the present invention will be described.

When ironing an upper garment, as shown in FIG. 7, the upper garment 10 is inserted into the shirt part 8 of the ironing plate 2 like it is worn thereto, and the plane surface 2*a* or curved surface 2*b* of the ironing plate 2 is upwardly faced and are supported by the leg part 18 based on a user's selection.

In a state that the plane surface 2*a* of the ironing sand 2 is upwardly faced, the user first irons the back surface of the upper garment 10 positioned at the plane surface 2*a* of the ironing plate 2.

After the user completes ironing the back surface positioned at the plane surface 2*a*, the user maintains a state that the upper garment 10 is inserted. In this state, the curved surface 2*b* that is a back surface of the ironing plate 2 is inverted and is upwardly faced. At this time, one end of the legs 22 is placed on the support groove 2*c* of the ironing plate 2, and the other end of the same is inserted into the insertion groove 2*d* of the ironing plate 2, for thereby fixing the ironing plate 2.

In the method for engaging the ironing plate 2 to the leg part 18, the other ends 22*a* of the legs 22 are inserted into the insertion groove 2*d* of the ironing plate 2, and the other end 22*b* of the ironing plate 2 is placed on the support groove 2*c*.

Figure 8:
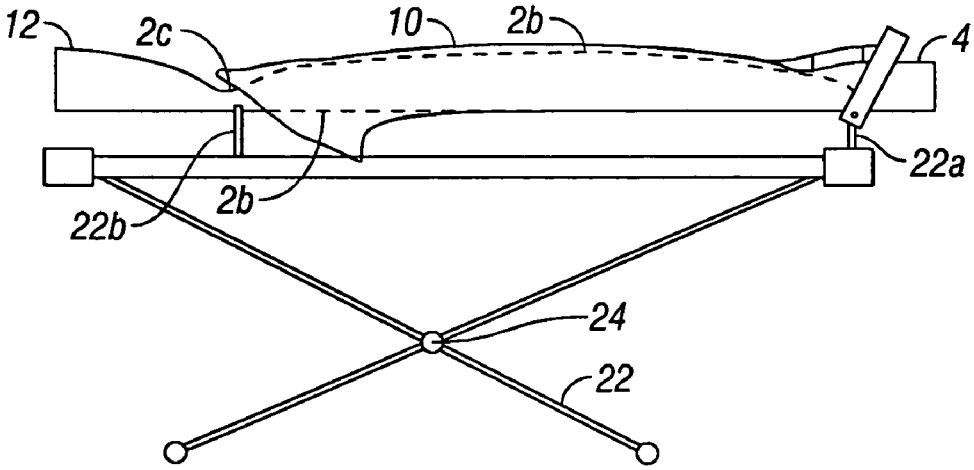
FIG. 8 is a view illustrating a state that a curved part of a double-sided ironing plate is used according to a first embodiment of the present invention.

As shown in FIG. 8, in a state that the curved surface 2*b* of the ironing plate 2 is positioned on the upper side, the front side of the upper garment is ironed, so that the ironing of the upper garment 10 of the leg portions is completed.

In addition, the lower garment such as trousers, etc. is ironed in the state shown in FIG. 6. Namely, the front side of the trousers 14 is positioned at the curved surface 2*b* of the ironing plate 2, so that it is possible to effectively iron the front side of the trousers 14 having wrinkles through the curved surface 2*b* protruded.

It is possible to effectively iron the lateral surface and hip portion of the trousers 14 by turning the trousers 14 inserted into the lower garment part 12.

In an ironing plate for ironing clothes of the double-sided ironing plate according to a second embodiment of the present invention, there is provided a double-sided ironing plate of which upper and lower surfaces are used for ironing. A support part is adapted to support the ironing plate. There is provided a support part connected with one end of the support part for thereby supporting one end of the ironing plate wherein the ironing plate is tiltable in the upper and lower directions and is rotatable in the left and right direction. Here, the support part includes a stay portion formed at one end of the support part, and a stay port formed at one end of the ironing plate wherein the stay portion is received thereinto. A first hinge part is formed at the support part, so that the ironing plate is tiltable in the upper and lower directions.

In addition, the support part includes a circular protrusion part formed at one end of the support part, and a receiving groove formed at one end of the ironing plate wherein the protrusion part is received thereinto. The first hinge part is preferably formed in the support part so that the ironing plate is tiltable in the upper and lower directions. The support part preferably includes a pair of first legs provided at a certain interval wherein the support part is formed at one end of the same, and a pair of second legs provided between the first legs and engaged by a second hinge wherein one end of each of the same supports the ironing plate. The ironing plate includes a shirt part that has a human body shaped cross section wherein an upper garment is worm, and a back surface is plane, and an upper surface is curved, a sleeve part that is connected with one end of the shirt part wherein a sleeve portion of a suit of clothes is inserted for helping ironing, and a back surface is plane, and an upper surface is curved, and a lower garment part that is connected with the other end of the shirt part wherein a back surface is plane for thereby performing ironing in a state that a lower garment is inserted, and an upper surface is curved.

In addition, an insertion groove is preferably inserted into the interior of one end of the shirt part, so that the sleeve part is inserted. A holder is provided in the lower garment part for fixing the lower garment inserted. The holder is preferably tongs. In the present invention, the double sides are used, and the front and back sides as well as the curved portions of clothes are well ironed based on the ironing surfaces 3D-formed along the curves of human body in a state that clothes are inserted to the ironing plate. In the present invention, wrinkles are not formed. Furthermore, there are provided ironing portions designed to be matched with the portions of upper garment, sleeves of clothes, and lower garment, so that an ironing efficiency is enhanced, and a double-sided ironing is implemented.

The second embodiment of the present invention will be described.

Figure 9:
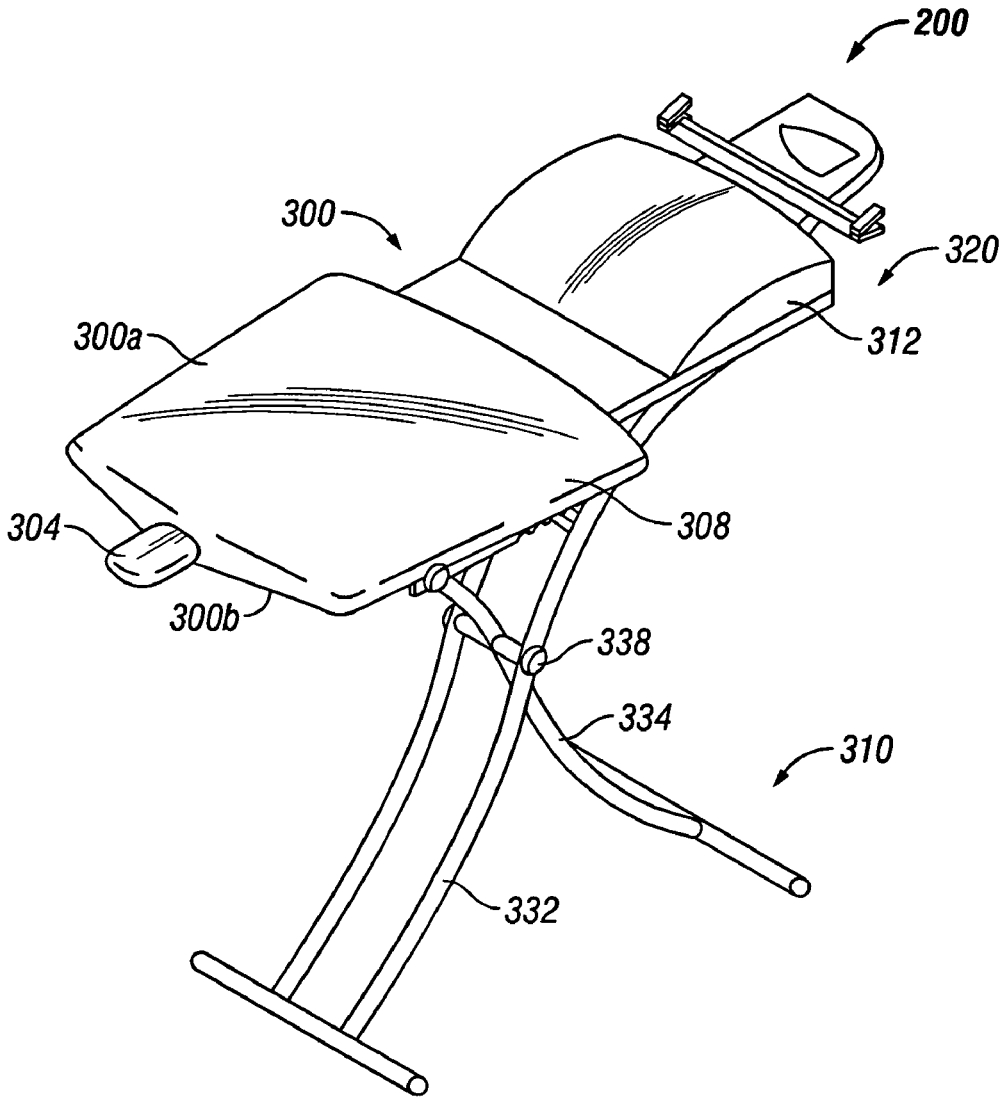
FIG. 9 is a perspective view illustrating a double-sided ironing plate according to a second embodiment of the present invention.

As shown in FIG. 9, in the double-sided ironing plate 200 according to the present invention, there is provided a double-sided ironing plate 300 of which upper and lower surfaces may be used for ironing. A support 310 supports the ironing plate 300. A support 320 is adapted to support an end of the ironing plate 300 at one end of the support part 310, so that the ironing plate 300 is tiltable in the upper and lower directions and is rotatable in the left and right directions.

In the ironing plate 300 according to the second embodiment of the present invention like the first embodiment, it is designed to iron using both sides of the ironing plate. The back surface of the ironing plate 300 is formed of a plane 300*b*, and the upper surface of the same is formed of a curbed surface 300*a* having a 3D curve.

A sleeve part 304 is provided at one end of the ironing plate 300 for ironing sleeves or shoulders of a suit of clothes such as Y-shirt, etc. In the sleeve part 304, the shape of the cross section is a rectangular shape of which an upper side is protruded, so that the sleeves of clothes are inserted. Therefore, in a state that the sleeves are inserted, it is possible to naturally iron based on the shape of the sleeves.

In addition, the sleeve part 304 is designed to perform an ironing operation with respect to a narrow portion such as sleeves or shoulder of clothes.

In addition, the shirt part 308 is formed at the intermediate portion of the ironing plate 300 connected with the sleeve part 304 wherein an upper garment such as Y-shirt is inserted thereinto. The upper garment is inserted into the shirt part 308 like a person wears an upper garment.

At this time, the back surface of the upper garment is positioned at a portion of the plane 300*b* of the ironing plate 300, and the front surface of the upper garment is positioned at a portion of the curved surface 300*a* of the ironing plate 300, so that it is possible to iron based on the characteristic of upper garment.

In the other end of the ironing plate 300, a rectangular or dovetail shaped lower garment part 312 is formed, so that a lower garment such as trousers is inserted thereinto. The trousers are inserted into the lower garment part 312 for thereby performing ironing.

Since the curved surface 300*a* of the upper surface of the ironing plate 300 into which the trousers are inserted is protruded, when ironing a front side of the trousers, it is possible to easily iron. In addition, the backsides of the trousers as well as the lateral sides may be effectively ironed.

Furthermore, the wrinkles formed in the front side of the trousers may be effectively ironed. In addition, the hip part of the trousers may be effectively ironed through the plane 300*b* that is a back surface.

There is provided a support part 320 in such a manner that the plane 300*b* of the back surface and the curved surface 300*a* of the upper surface are rotated in a state that a suit of clothes is inserted in the double-sided ironing plate 200 according to the second embodiment of the present invention in the second embodiment of the present invention.

Figure 10:
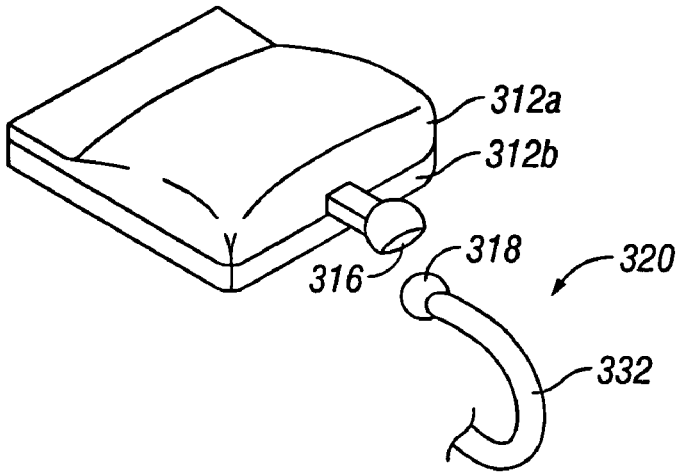
FIG. 10 is a perspective view illustrating a support part of a double-sided ironing plate according to a second embodiment of the present invention.
Figure 11:
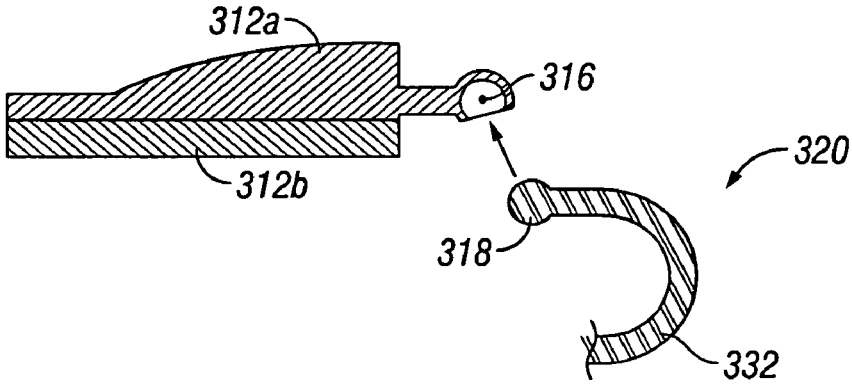
FIG. 11 is a cross sectional view of FIG. 9.

As shown in FIGS. 10 and 11, there is provided the support part 320 by which the ironing plate 300 is tiltable in the upper and lower directions and is rotatable in the left and right directions.

The lower garment part 312 is formed based on an engagement of the upper part 312*a* and the lower part 312*b*. A stay port 316 is formed at the end of the engagement.

A stay 318 formed at one end of a first leg 332 capable of supporting the ironing plate 300 is positioned in the stay port 316.

Therefore, the user can move the ironing plate 300 in the upper, lower, left and right directions based on the support part 320.

Figure 12:
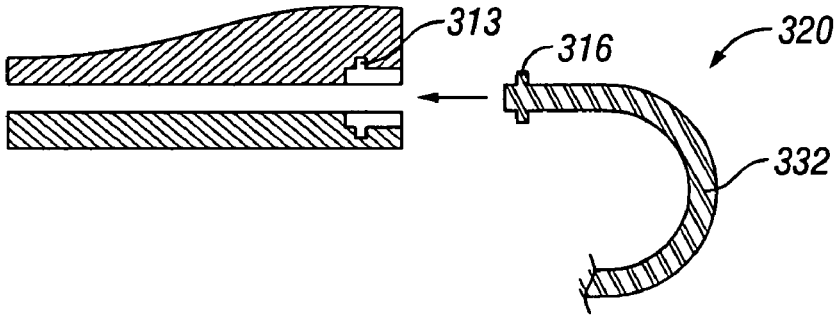
FIG. 12 is a cross sectional view illustrating an example of a support part of FIG. 10.
Figure 13:
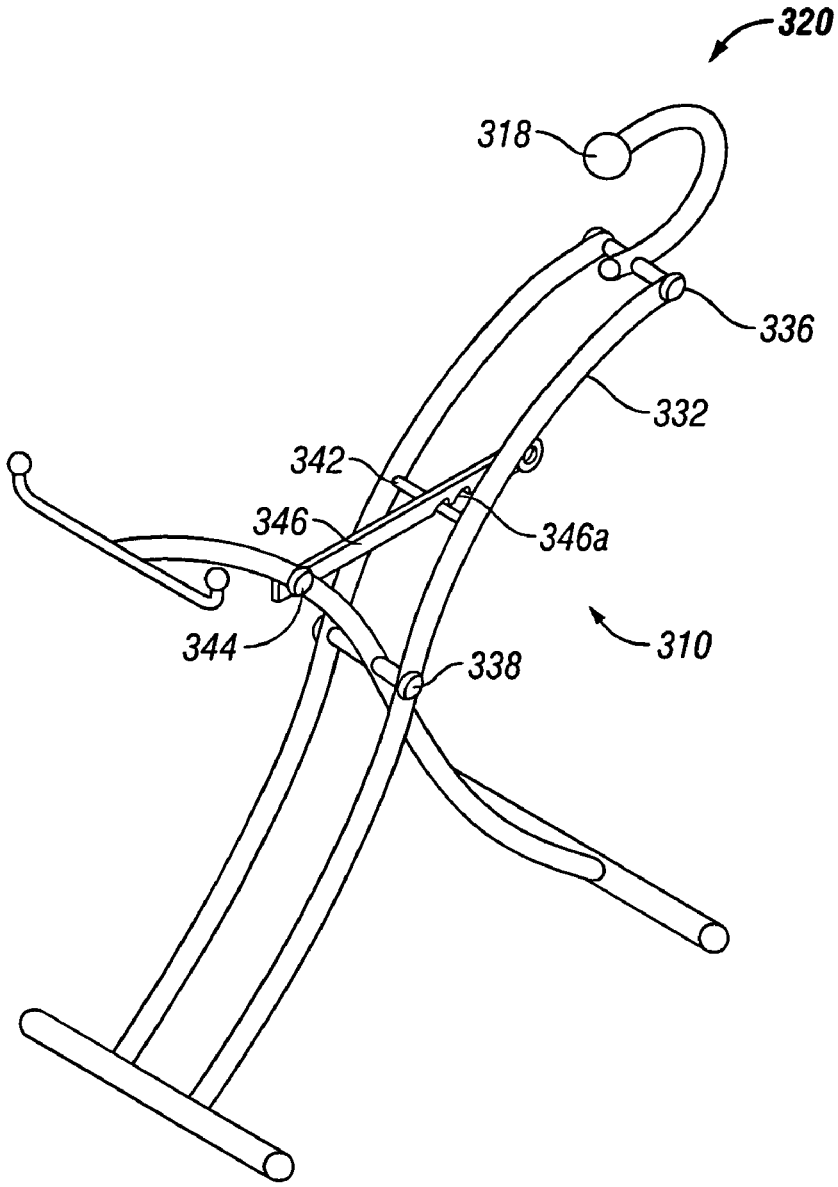
FIG. 13 is a perspective view illustrating a leg part of a double-sided ironing plate according to a second embodiment of the present invention.

FIG. 12 is a view illustrating the support part 320 according to another embodiment of the present invention. A circular protrusion 316 is formed at one end of the first leg 332, and a receiving groove 313 is formed in the lower garment part 312 in which the circular protrusion part 316 is positioned.

FIGS. 13 through 16 are views illustrating the support part 310 capable of supporting the ironing plate 300 of the double-sided ironing plate 200 according to a second embodiment of the present invention. As shown in FIG. 10 or 12, the first leg 332 engaged with the first hinge 336 is provided at one end of the ironing plate 300 in cooperation with the support part 320, and the second leg 334 is engaged with the first leg 332 using the second hinge 338.

Here, the first leg 332 is provided in pair at a certain interval, and the first legs 332 have a horizontal direction bar 342 for supporting and connecting the same. The second leg 334 is provided between the first legs 332.

One end of the second legs 334 is connected with the second leg 334 by a third hinge 344, and a hanging bar 346 is provided on the other end of the same for thereby being hung thereon wherein the hanging bar 346 has a plurality of hanging grooves 346*a*. The first legs 332 and the second legs 334 are connected through the hanging bar 346, so that the ironing plate 300 is stably supported.

A plurality of the hanging grooves 346*a* formed in the hanging bar 346 are hung on the horizontal direction bar 342 based on a user's selection, so that it is possible to adjust based on the height of user.

The operation of the double-sided ironing plate 200 according to the second embodiment of the present invention will be described.

Figure 14:
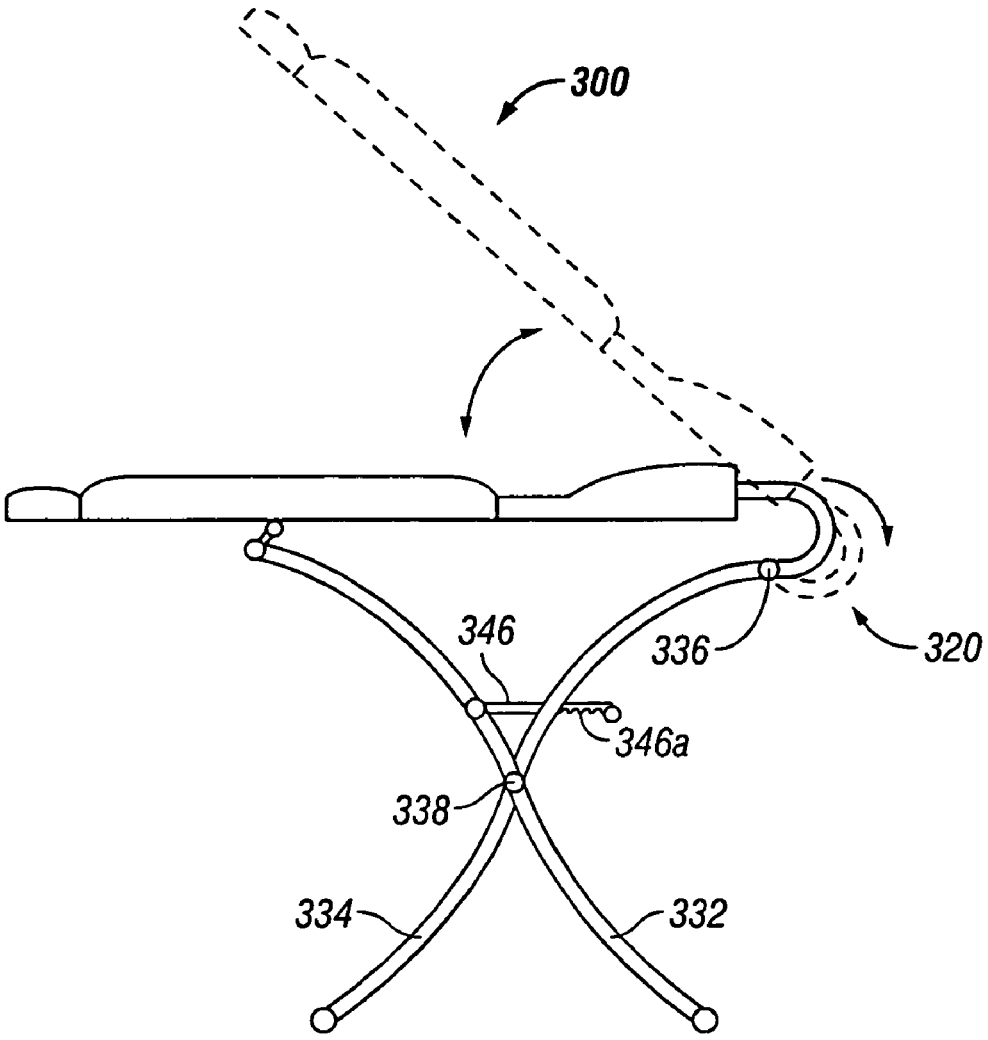
FIGS. 14 through 16 are views illustrating an operation state of an ironing plate according to a second embodiment of the present invention.

In the state of FIG. 9, the user holds a free end of the ironing plate 300 supported by the second leg 334 and then lifts up the ironing plate 300 as shown in FIG. 14. At this time, the ironing plate 300 is naturally lifted up by the support part 320 connected to one end of the first leg 332.

In addition, as the ironing plate 300 is lifted up, the first hinge 336 of the first leg 332 is also tilted.

Figure 15:
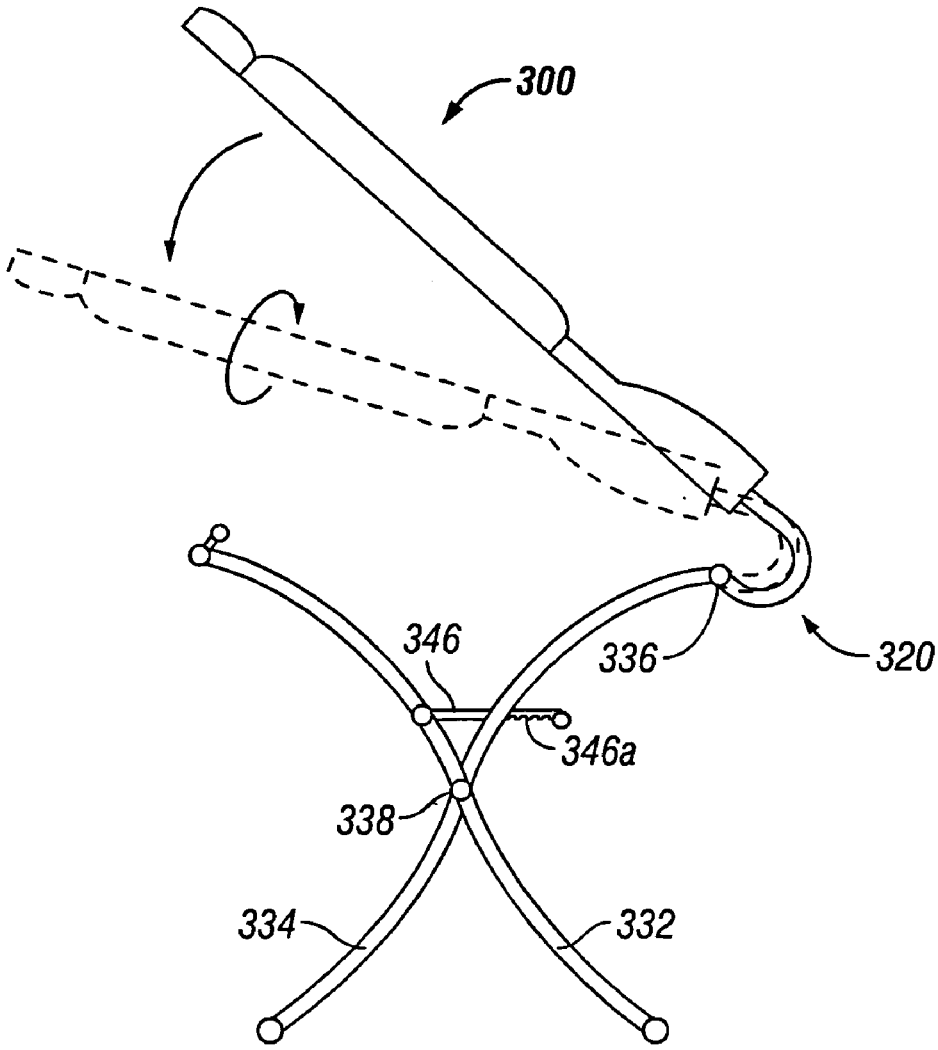

Thereafter, the lifted-up ironing plate 300 is rotated as shown in FIG. 15, so that the upper surface of the curved surface 300*a* is position-changed with the back surface of the plane 300*b*.

Figure 16:
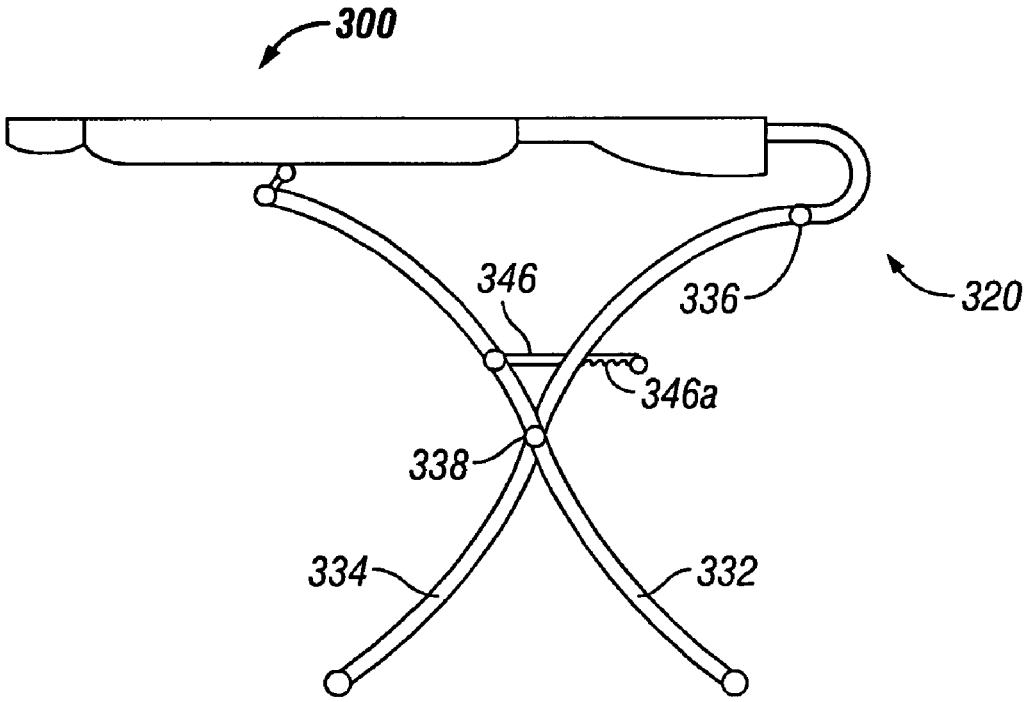

In a state that the upper surface and the back surface are position-changed, the user holds the other end of the ironing plate 300 as shown in FIG. 16, and the ironing plate 300 is supported by the second leg 334. Therefore, the plane 300*b* is positioned on the upper side, and the curved surface 300*a* is positioned in the lower side in the ironing plate 300.

In the above state, the double-sided ironing plate 200 according to the second embodiment of the present invention includes the sleeve part 304, the shirt part 308, the lower garment part 312 that operate based on the characteristics of corresponding clothes with respect to the sleeve part and shoulder part of Y-shirt, and the upper garment such as Y-shirt, and trousers.

Figure 17:
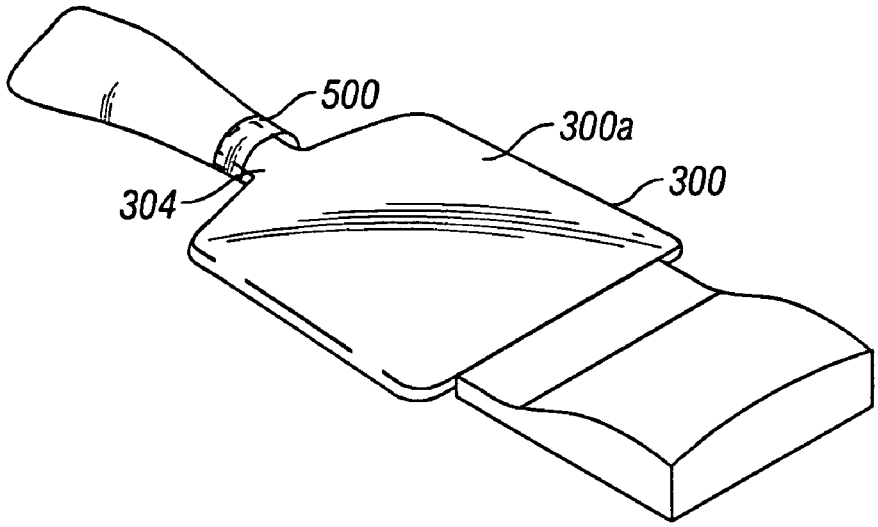
FIGS. 17 through 20 are views illustrating a use state of an ironing plate according to a second embodiment of the present invention.

In the case of sleeve, as shown in FIG. 17, in a state that the sleeve 500 is inserted into the sleeve part 304, the ironing operation is performed. Since the sleeve part 304 is formed of a curved surface in a rounded shape formed based on the shape of the sleeve 500, it is possible to effectively iron the sleeve 500.

Furthermore, it is possible to effectively iron the narrow portions such as shoulder portions.

Figure 18:
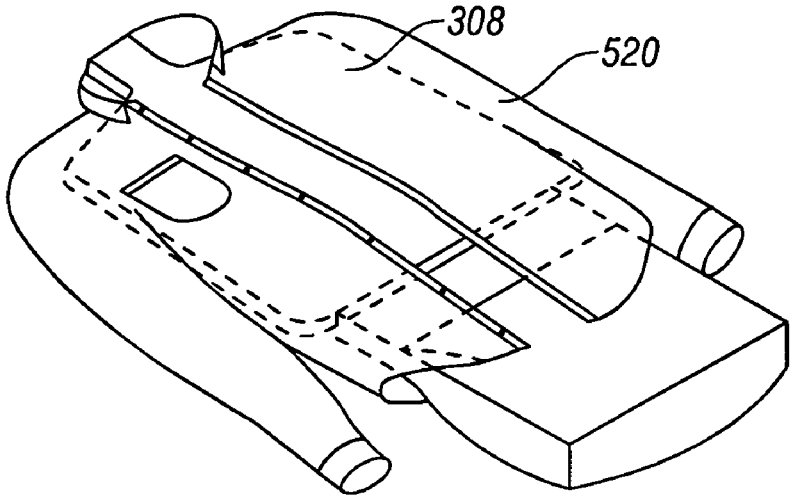

In the case that the upper garment is ironed, as shown in FIG. 18, the upper garment 520 is worn to the shirt part 308 of the ironing sand 300 like a person wears clothes, and the plane 300*b* or the curved surface 300*a* of the ironing plate 300 is upwardly faced based on the user's selection.

In a state that the plane 300*a* that is one surface of the ironing plate 300 is upwardly faced, the user first irons the back surface of the upper garment 520 positioned at the plane 300*b* of the ironing plate 300.

After the user irons the back surface of the plane 300*b*, the user maintains a state that the upper garment 520 is worn. In this state, the user inverts the ironing plate 300 in such a manner that the curved surface 300 that is a back surface of the ironing plate 300 is upwardly faced, so that the curved surface 300*a* is ironed.

Figure 19:
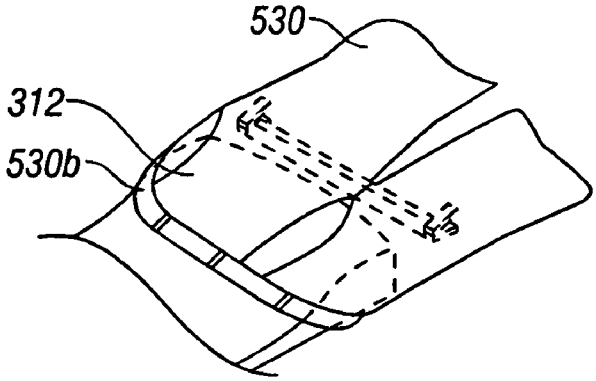
Figure 20:
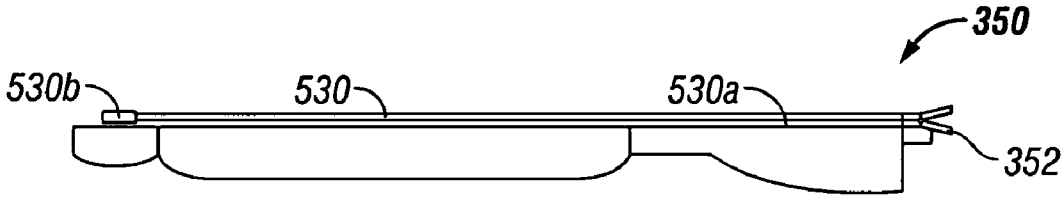

In the case of the lower garment such as trousers, as shown in FIGS. 19 and 20, the hip part and leg part are separately ironed. First, when ironing the hip part, the trousers 530 are putted onto the lower garment part 312 of the ironing plate 300, and the ironing is performed.

At this time, it is possible to iron the portions such as hip part based on the shape of clothes through the protruded and curved surface 300*a* of the lower garment part 312.

When ironing the trousers 530, there is provided a holder 350 in the lower garment part 312 for holding the leg part 530*a* of the trousers 530. The holder 350 is tongs generally found in our surroundings.

As shown in FIG. 20, when ironing the leg part 530*a* of the trousers 530, the plane 300*b* of the ironing plate 300 is upwardly faced, and the leg part 530*a* of the trousers 530 is placed on the plane 300*b*, and the leg part 530*a* of the trousers 530 is held using the tongs 352.

At this time, a belt part 530*b* of the trousers 530 is positioned at the sleeve part 304.

In a state that the leg part 530*a* is caught by the tongs 352, the user irons the leg part 530*a* in a state that the belt part 530*a* is pulled in a state that the user holds the belt part 530*b* of the trousers 530.

In the above state, in a state that the trousers 530 are putted on, the front sides of the trousers 530 having the wrinkles are ironed through the curved surface 300*a* protruded.

In addition, it is possible to effectively iron the lateral sides and hip parts of the trousers 530 by turning the trousers 530 putted onto the lower garment part 312. The leg part 530*a* is ironed in a state that the plane 300*b* is upwardly faced.

In a state that the leg part 530*a* of the trousers 530 is caught by the tongs 352, since the user's one hand that does not catch the ironing machine is idle, the portions of the wrinkles are pulled using the idle hand for thereby enhancing an efficient ironing.

Figure 21:
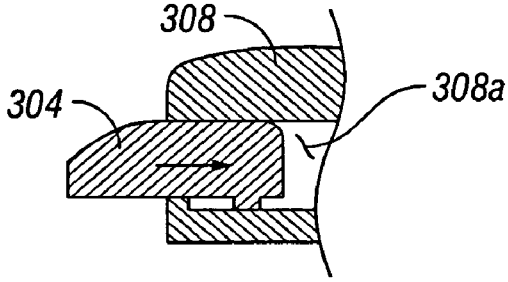
FIG. 21 is a cross sectional view illustrating a sleeve part of a double-sided ironing plate according to a second embodiment of the present invention.

FIG. 21 is a view illustrating the construction that an insertion groove 308*a* is formed in the shirt part 308 so that the sleeve part 304 of the double-sided ironing plate 200 according to the second embodiment of the present invention is used if necessary. When ironing the sleeves 500, the sleeve part 304 is extended and exposed to the outside.

In the case that the sleeve part 304 is not used, the sleeve part 304 is pushed into the insertion groove 308*a* formed in the shirt part 308 so that the sleeve part 304 is not exposed to the outside.

In the double-sided ironing plate according to the present invention, the double surfaces are used for ironing. In the present invention, it is possible to effectively iron the front and back sides as well as the curved surfaces of clothes such as back or hip portion in a state that the clothes are tightly putted onto the ironing plate based on the ironing surface 3D-formed based on the curves of human body. Therefore, the wrinkles are not formed, and the ironing efficiency is enhanced.

The present invention is not limited to the above embodiment. As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In an ironing plate designed to iron clothes, a double-sided ironing plate comprising:

a sleeve part having a rectangular cross section wherein a sleeve part of clothes is pulled onto the same;

a shirt part that is integrally connected with the sleeve part and has a human body shaped cross section so that front and back surfaces of clothes are ironed in a state that an upper garment is put onto the ironing plate; and a lower garment part that is connected with the shirt part and is formed in a dovetail shape for thereby performing an ironing operation in a state that a lower garment is put on, wherein one surface of the sleeve part, shirt part and lower garment part forming the ironing plate is plane, and the back surface is formed of a 3D curved surface.

2. The plate of claim 1, wherein said ironing plate includes a leg part capable of maintaining an inverted state of one surface and a back surface of the ironing plate so that a double surface ironing is achieved by changing the front and back surfaces in a state that clothes are put on, wherein said leg part includes:

a support frame;

a plurality of legs wherein one end of each of the same is connected with the support frame; and a support groove and an insertion groove formed in the ironing plate in such a manner that the legs are crossed from each other, and a hinge portion is formed at the crossing portion, and the other end of each of the legs is positioned.

3. An ironing plate comprising, in combination:

a double sided ironing plate of which upper and lower surfaces are used for ironing;

a support adapted to support the ironing plate;

a support part that is connected with one end of the support and supports one end of the ironing plate, so that the ironing plate is tiltable in the upper and lower directions and is rotatable in the left and right directions, said support part including a circular protrusion formed at one end of the support part;

a receiving groove formed at one end of the ironing plate for receiving said protrusion therein, and, wherein said support includes:

a pair of legs in which said support part is provided at one end of each of the same, and said legs are provided at a certain interval;

a second leg provided between the first legs by a hinge wherein one end of the same supports the ironing plate.

4. The plate of claim 3, wherein said ironing plate includes:

a shirt part that has a human body shaped cross section wherein an upper garment is put onto the same, a back surface is plane, and an upper surface is curved;

a sleeve part that is connected with one end of the shirt part wherein a sleeve part of clothes is inserted for thereby achieving ironing, and a back surface is plane, and an upper surface is formed of a curved surface; and a lower garment part connected with the other end of the shirt part wherein a back surface is plane, and an upper surface is formed of a curved surface for thereby achieving an ironing operation in a state that a lower garment is put onto the ironing plate.

5. The plate of claim 4, wherein an insertion groove is formed in the interior of an end of the shirt part wherein the sleeve part is inserted thereinto.

6. The plate of claim 5, wherein a holder is provided in the lower garment part for fixing the put on lower garment, and said holder comprises tongs.

* * * * *